United States Patent [19]

Keene, deceased

[11] 4,241,578

[45] Dec. 30, 1980

[54] FLUID STORAGE TANK FOR AN INDUSTRIAL VEHICLE

[75] Inventor: Derek K. Keene, deceased, late of Philadelphia, Pa., by Judith H. Keene, executrix

[73] Assignee: Eaton Corporation, Cleveland, Ohio

[21] Appl. No.: 49,520

[22] Filed: Jun. 18, 1979

[51] Int. Cl.[3] ..... F15B 1/06; F15B 21/04

[52] U.S. Cl. ..... 60/478; 60/378; 60/455; 137/575; 137/593

[58] Field of Search ..... 60/378, 453, 455, 477, 60/478; 137/575, 587, 563, 593; 220/86 R

[56] References Cited

U.S. PATENT DOCUMENTS

| | | | |
|---|---|---|---|
| 3,805,829 | 4/1974 | Yamamoto et al. | 137/575 |
| 3,960,174 | 6/1976 | Latimer et al. | 137/563 |
| 3,991,568 | 11/1976 | Latimer et al. | 60/327 |

*Primary Examiner*—Irwin C. Cohen

*Attorney, Agent, or Firm*—R. J. McCloskey; F. M. Sajovec, Jr.

[57] ABSTRACT

A hydraulic fluid storage tank for an industrial vehicle. A small surge tank (44) is mounted on top of a main tank (10) and communicates with the main tank via a drain back hole (49) formed in the top of the main tank. A first breather tube (46), having one end opening within the surge tank, extends directly into the main tank. A second breather tube (48), having one end opening within the surge tank, enters the main tank through the drain back hole, extends along the top of the tank, and opens into the tank at a point substantially rearward of the first vent tube. If, due to movement of the vehicle, one of the breather tubes becomes filled with oil, the other will still function. Oil which momentarily floods one of the breather tubes enters the surge tank and drains back to the main tank via the drain back hole.

3 Claims, 4 Drawing Figures

FLUID STORAGE TANK FOR AN INDUSTRIAL VEHICLE

This invention relates to fluid storage tanks, and particularly to a hydraulic oil reservoir in an industrial vehicle.

In a hydraulic oil reservoir installed in an industrial lift truck, the breather is usually mounted toward the front end of the tank. Upon braking the oil floods forward inside the tank, covering the breather hole. If, during the time when the vehicle is being braked, the load is lowered, pressure is created inside the tank as the lift cylinder gives up oil to the tank. The pressure thus created causes oil to be forced out of the breather hole and into the breather cap or filter. Eventually this oil weeps to the outside of the tank. If the tank is mounted transversely, the same conditions can occur when the load is lowered while the vehicle is turning.

To obviate the above problems, the present invention provides two breathing means. One is a short tube in the top of the reservoir connecting it to a small surge tank on top of the reservoir, with a drain hole connecting the two tanks. The second breathing means is a long tube entering the surge tank and extending along the inside top wall of the reservoir to the opposite end of the tank. The tube ends are located close to the top of the surge tank to allow oil which has entered the surge tank to return to the reservoir as the tubes let air out of the tank. Oil which collects in the surge tank will either drain back to the reservoir via the drain hole provided, or be drawn back when a subsequent lifting motion is made.

If a flooding condition blocks the short breather tube and the drain hole, the long breather tube assures that no pressure will build up in the reservoir so that little oil enters the surge tank. Conversely, if a flooding condition blocks the long breather tube, the short breather tube assures no pressure buildup.

A breather hole is located in the top of the surge tank connecting the surge tank to a tube which can be used for mounting a breather cap.

Other advantages of the invention will become apparent from the following description when taken in connection with the accompanying drawings, wherein.

Figure 1:
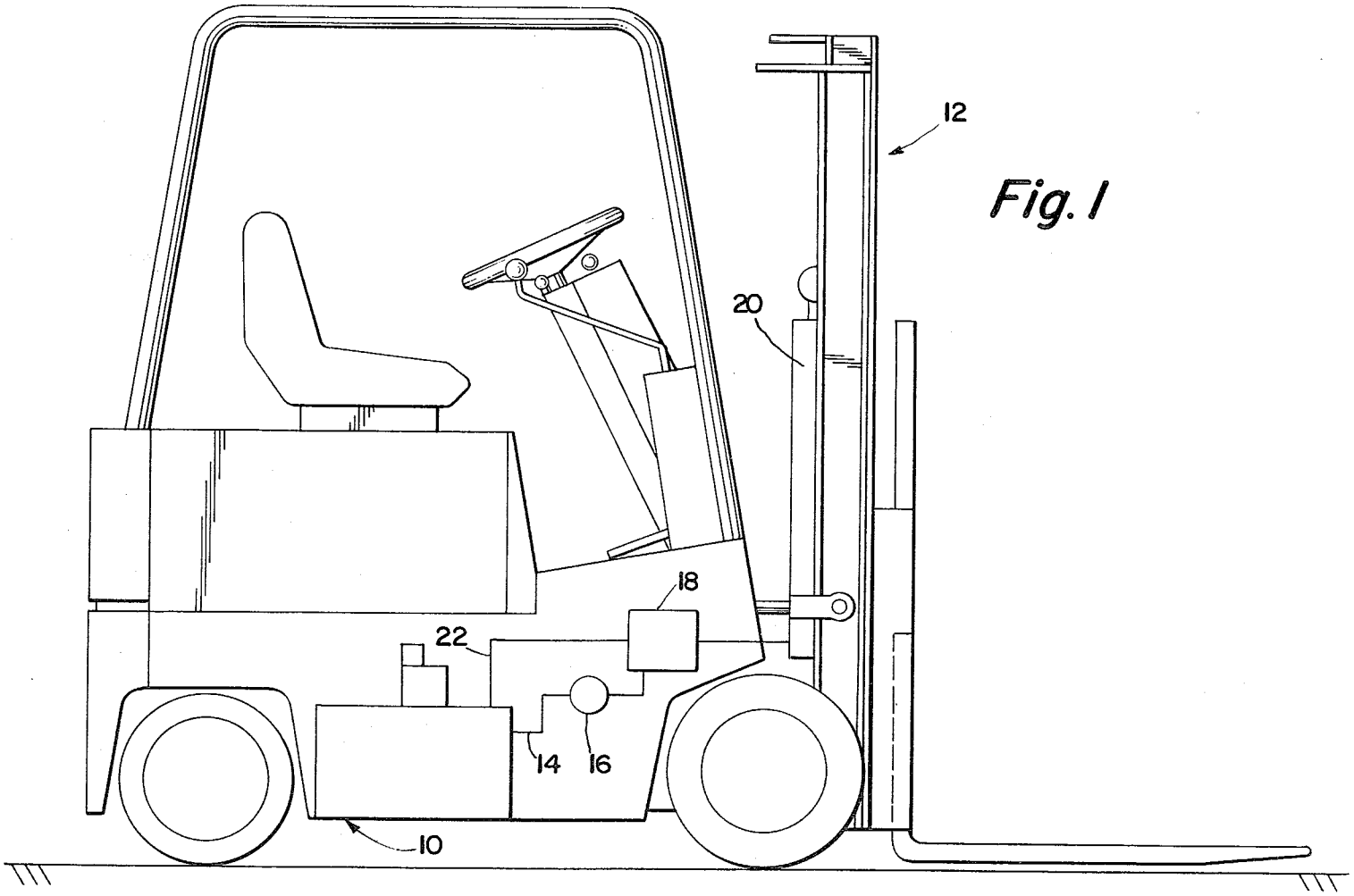
FIG. 1 is a side elevation view of an industrial truck incorporating the invention.

Referring to FIG. 1, the fluid storage tank 10 of the invention is schematically illustrated as it is installed in the hydraulic system of an industrial truck 12, comprising the tank 10, a suction line 14, a hydraulic pump 16, a control valve 18, one or more hydraulically actuated components such as a lift cylinder 20, and a return line 22 from the control valve to the tank.

Figure 2:
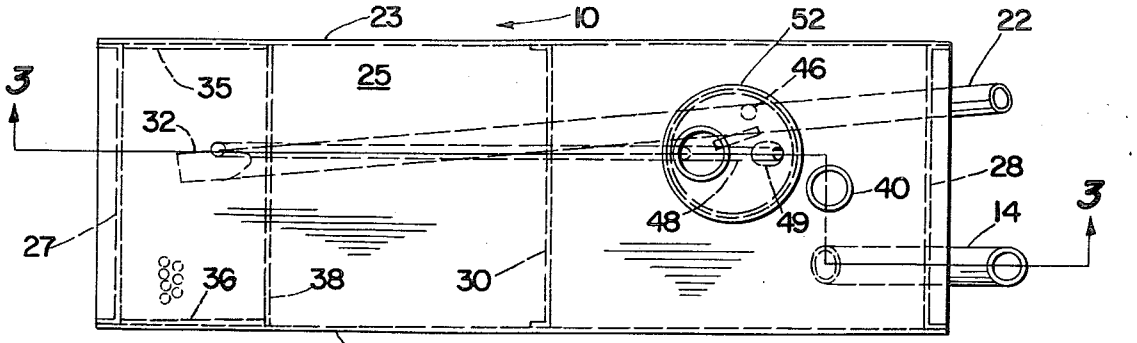
FIG. 2 is a plan view of the invention.
Figure 4:
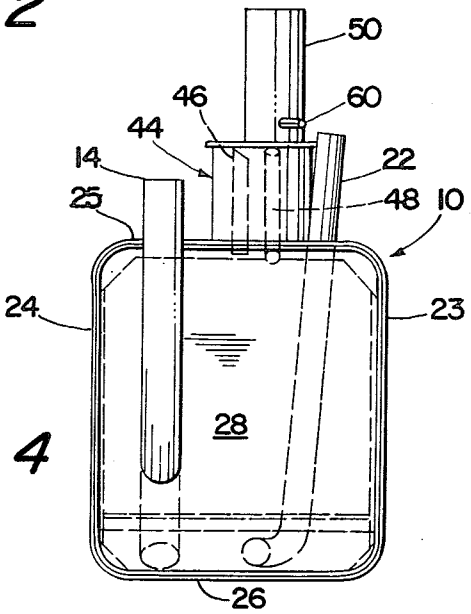
FIG. 4 is a front elevation view of the invention.
Figure 3:
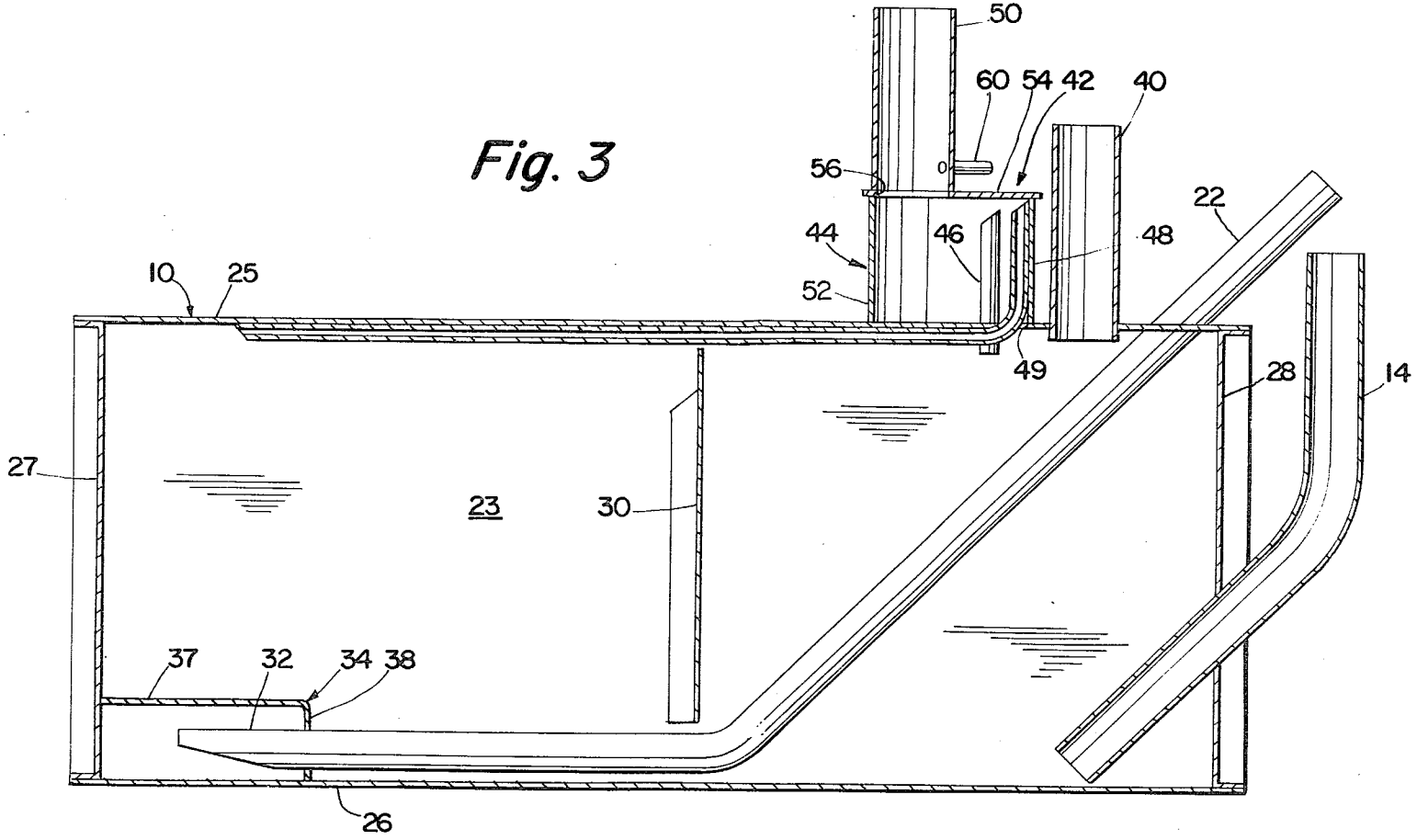
FIG. 3 is a section view taken along line 3—3 of FIG. 2.

Referring to FIGS. 2 and 3, fluid storage tank 10 comprises side walls 23, 24, upper wall 25, lower wall 26, and end walls 27, 28. In the illustrative embodiment, the tank is formed as a rectangular tubular member which defines the walls 23, 24, 25, 26 with end plates welded thereto to define the walls 27, 28. An internal baffle plate 30 may also be welded to the interior of the tank. It will be appreciated that the actual shape and structure of the tank per se is not important to the invention; and that the invention is applicable to a variety of tank shapes and modes of fabrication.

The return line 22 extends downward into the tank through the upper wall 25 and ends in an angled opening at the end 32 thereof, which is received in a perforated diffusing structure 34 formed at the rear (left side as viewed in FIG. 3) of the tank 10. The diffusing structure, as shown is defined by the end wall 27, lower wall 26, separate side wall sections 35 and 36, a perforated upper wall 37 and an end wall 38 all welded together to form a protected structure which diffuses the returning fluid to prevent foaming and the like. The end 32 of return line 22 extends into the diffusing structure through a hole formed in the end wall 38 and ends adjacent the bottom of the tank.

The suction line 14 extends through a hole formed in the end wall 28 of the tank and ends adjacent the bottom of the tank as shown in FIG. 3.

A filler pipe 40 extends through the upper wall 25 and opens into the top of the tank.

In accordance with the invention, a breather assembly is provided, designated generally by the numeral 42, which minimizes the possibility of oil flooding the tank breather and splashing out of the tank.

The breather assembly comprises a surge tank 44 welded to the upper wall 25 of the tank 10; a first vent or breather tube 46 disposed within the surge tank and opening into the forward end of tank 10 through a hole formed in the upper wall 25; a second vent or breather tube 48 having one end disposed within the surge tank, extending into the tank 10 through a hole 49 formed in the upper wall, and extending rearward to open into the tank 10 adjacent the inside of wall 25 at a point substantially rearward of the first breather tube 46; and a breather cap tube 50 mounted on top of the surge tank 44 and extending upward therefrom.

In the preferred embodiment of the invention the surge tank 44 comprises a tube 52 having an open end welded to the upper wall 25 of tank 10, with a cover plate 54 welded to the other end. A breather hole 56 is formed in the cover plate 54 and the breather cap tube 50 comprises a tube having one end welded to the cover plate at a point overlying the breather hole 56. A standard breather cap can be placed over the other end of the tube 50.

The first breather tube 46 extends through a hole which is only slightly larger than the outside diameter of the tube, and the tube is welded to the wall 25 around the hole. The hole 49 through which the second breather tube 48 extends, however, defines a drain-back hole which is substantially larger than the outside diameter of the tube, and the tube is fixed to the inside of wall 25 by welding along its length.

In some cases a drain line is provided in the lift cylinder 20 to accommodate leakage past the cylinder seals, and in such cases a drain tube 60 is received through the side of the breather cap tube 50.

I claim:

1. In a hydraulic system for an industrial vehicle comprising a fluid storage tank, a pump, a suction line extending into said storage tank and operatively connected to the inlet of said pump, a control valve operatively connected to the outlet of said pump, one or more hydraulically actuated components operatively connected to said control valve, and a return line extending into said storage tank and operatively connected to said one or more hydraulically actuated components; the improvement wherein said storage tank includes means defining an upper wall thereof, a surge tank in communication with said storage tank, said surge tank comprising a tubular member having a plate attached to one end to define an upper wall thereof and having the other end attached to said storage tank such that said upper wall defines a lower wall of said surge tank, a first vent tube having one end opening into said surge tank adjacent said upper plate and the other end opening into said storage tank, a second vent tube having one end opening into said surge tank adjacent said upper plate and the other end opening into said storage tank at a point spaced from the point where the first vent tube opens into said storage tank, drain means connected between said surge tank and said storage tank, and means venting said surge tank to atmosphere.

2. Apparatus as claimed in claim 1, in which said means venting said surge tank to atmosphere comprises an aperture formed in said upper end plate, and an elongated breather tube having one end attached to said upper end plate overlying said aperture and extending vertically upward from said upper end plate.

3. Apparatus as claimed in claim 1, including an aperture defining said drain means formed through said upper wall, said surge tank communicating with said storage tank via said aperture; wherein said first vent tube extends through said upper wall and opens into said storage tank adjacent the inside of said upper wall, and said second vent tube extends through said aperture and along the inside of said upper wall and opens into said storage tank adjacent said upper wall, the area of said aperture being greater than the cross sectional area of said second vent tube, whereby clearance is provided between the edge of said aperture and the outside diameter of said second vent tube.

* * * * *